United States Patent [19]

Tuppini

[11] 3,948,040

[45] Apr. 6, 1976

[54] HINGED BRACELET AND METHOD OF MAKING THE SAME

[75] Inventor: Remigio Tuppini, Verona, Italy

[73] Assignee: Andreas Daub, Pforzheim, Germany

[22] Filed: May 7, 1975

[21] Appl. No.: 575,968

[30] Foreign Application Priority Data

May 25, 1974 Germany ..... 2425407
June 7, 1974 Germany ..... 2427512

[52] U.S. Cl. ..... 59/35 R; 59/82
[51] Int. Cl.[2] ..... B21L 9/00; F16G 15/12
[58] Field of Search ..... 59/80, 82, 78, 90, 91, 59/12, 35; 224/4 B, 4 D, 4 H; 63/4

[56] References Cited

UNITED STATES PATENTS

| | | | |
|---|---|---|---|
| 1,898,402 | 2/1933 | Smith | 59/80 |
| 2,920,442 | 1/1960 | Kunzmann | 63/4 |
| 3,690,064 | 9/1972 | Pompeo | 59/80 |

*Primary Examiner*—C. W. Lanham
*Assistant Examiner*—Gene P. Crosby
*Attorney, Agent, or Firm*—Spencer & Kaye

[57] ABSTRACT

In a hinged bracelet formed of a plurality of links arranged in several juxtapositioned, longitudinally extending rows, each link is formed of two link parts bonded to one another along a parting plane. Each link has two throughgoing bores extending transversely to the longitudinal direction of the bracelet and spaced from one another in the longitudinal direction. Each bore is formed by a longitudinally open groove provided in at least one of the link parts. The groove faces with its longitudinal opening, the other link part. Each bore accommodates a hinge pin extending transversely to the longitudinal direction of the bracelet.

11 Claims, 8 Drawing Figures

HINGED BRACELET AND METHOD OF MAKING THE SAME

BACKGROUND OF THE INVENTION

The present invention relates to a hinged bracelet including a plurality of adjacent rows of a series of links. Adjacent links are offset with respect to one another and are movably connected together by hinge pins which extend transversely to the longitudinal direction of the bracelet. Each link is traversed by two hinge pins.

Depending on whether the links in a row are arranged in contact with one another or with spacings therebetween, adjacent links must be offset with respect to one another by one-half the length of a link or by an appropriately greater amount.

It has been the practice to make the individual links for such hinged bracelets by bending a metal strip into hollow bodies which each enclose two hinge pins passing therethrough. At the ends, the metal strips are usually bent so that an articulated connection is obtained between the hinge pins and the links. In case such a solution is not feasible, perhaps due to special requirements regarding the external configuration of the links, it is known to eliminate play between the hinge pins and the links at least at the two longitudinal edges of the bracelet by filling the existing gaps with suitably shaped metal pieces. In such a case, the configuration of the individual links is limited due to esthetic considerations.

Finally, the known hinged bracelets have the drawback of incurring relatively high production costs in view of the expensive labor involved.

SUMMARY OF THE INVENTION

It is an object of the present invention to improve a hinged bracelet of the above-mentioned type so that its manufacturing costs are substantially reduced and considerable freedom exists in the external configuration of the links while the hinge pins are securely held in the links over the entire width of the bracelet.

This object and others to become apparent as the specification progresses, are accomplished by the invention according to which, briefly stated, in a hinged bracelet formed of a plurality of links arranged in several juxtapositioned, longitudinally extending rows, each link is formed of two link parts bonded to one another along a parting plane. Each link has two throughgoing bores extending transversely to the longitudinal direction of the bracelet and spaced from one another in the longitudinal direction. Each bore is formed by a longitudinally open groove provided in at least one of the link parts. The groove faces, with its longitudinal opening, the other link part. Each bore accommodates a hinge pin extending transversely to the longitudinal direction of the bracelet.

The solution according to the present invention is based on the recognition that it is possible to avoid the drilling of transverse bores (which produce a favorable effect but are uneconomical in manufacturing processes) in that grooves are provided in two complemental link parts. When the latter are combined, the registering grooves form bores to accommodate the hinge pins. In designing the position of the grooves, the longitudinal offset of adjacent rows of links has to be taken into account, so that the corresponding bores will extend in a throughgoing manner over the entire width of the bracelet.

The main advantage of the present invention is that the individual link parts can be made in a more economical drawing process in that two strips of the same width are continuously provided with one or two grooves; these two strips are then superimposed so that the grooves therein form the desired recesses (bores) for the hinge pins and then these two strips are continuously soldered or welded together. The individual finished links are severed from this double strip. In contradistinction, the known hinged bracelets require that all links be manufactured individually.

Since no gaps appear between the hinge pins and the links, the above-mentioned filling operation along the longitudinal edges of the bracelet is no longer required. The external configuration of the links is completely independent of the application of the bores for the hinge pins and consequently may vary widely. There exists, in particular, the possiblility of making the link parts from different materials; for example, a less expensive material may be used for the concealed, inside link parts of the bracelet, while a noble metal may be used for the exposed, outside link parts of the bracelet.

The thickness of the two link parts is also variable so that the hinge pins can be placed relatively close to the outside of the bracelet. The gaps appearing between the links on the outside of the bracelet when the bracelet is bent are thus kept very small and the bracelet is distinguished by a particularly pleasing surface appearance which is often of decisive significance for the decision to purchase such a bracelet.

The present invention can be realized, for example, in that a total of only two grooves per link are provided if such grooves have an approximately U-shaped cross section. However, it is also feasible to provide each link part with two grooves of approximately semicircular cross section so that, when the partial links are combined, two grooves form a bore to accomodate the hinge pins.

The link parts are expediently bonded to one another by welding; soldering or gluing processes are, however, also possible.

In order to assure dependable seating of the hinge pins in a simple manner, it is advantageous to hold the hinge pins in the two outer rows of the bracelet in a press fit, either by pressing together the two longitudinal edges of the bracelet or by using hinge pins which have thickened ends or by appropriately dimensioning the groove cross sections.

There is substantial freedom as to how the individual links are divided into two link parts. Care has to be taken merely that the parting plane is at least tangent to the bores that accommodate the hinge pins so that the bores can be produced by a simple drawing process, or, in special cases, by milling or pressing. If only one groove is to be placed in each link part, the parting plane should be oblique so that the hinge pins will all lie at the same level when the links are hinged to one another.

The grooves may have a U-shaped, triangular, rectangular, circular or elliptical and similar cross section. They should be dimensioned so that it is assured that the hinge pins are securely positioned therein.

The method of making the above-outlined bracelet includes the steps of continuously embossing (pressing) two grooves into two strips of identical width; superimposing the strips so that the grooves come to lie in the position suitable for accommodating the hinge pins; bonding the two strips together; and severing the double strip to obtain individual links.

DESCRIPTION OF THE PREFERRED EMBODIMENTS

Figure 1:
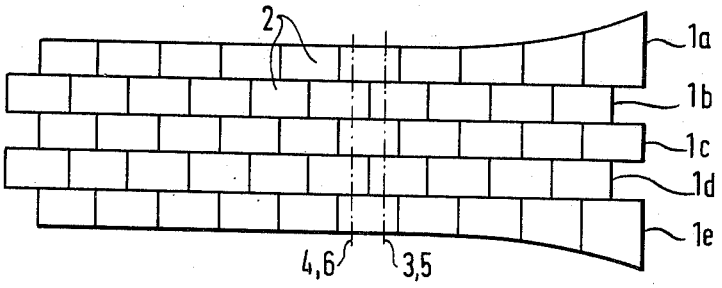
Fig.1 (PRIOR ART)
FIG. 1 is a top plan view of a link bracelet according to the prior art.
Figure 2:
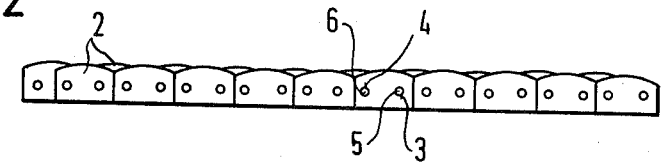
Fig.2 (PRIOR ART)
FIG. 2 is a side elevation view of the bracelet of FIG. 1.

FIGS. 1 and 2 illustrate a hinged bracelet according to the prior art. The bracelet includes five rows 1*a* to 1*e* of a series of links 2. The links 2 are shown as rectangles for simplicity's sake, their width increasing toward the right only in the two outer rows 1*a* and 1*e*. In order to ensure sufficient play for bending the bracelet during wear, the sides along which the individual links of one series contact one another are slightly inclined toward the inside. The angle of inclination is only a few degrees and is virtually imperceptible with the naked eye. All links are provided with two bores 3, 4 in a direction transverse to the longitudinal direction of the bracelet. The bores 3, 4 are so arranged that they are in alignment with the bores in the adjacent links which are offset by one-half a length of a link and pass through the entire width of the bracelet. The offset arrangement of the adjacent rows produces a continuous structure which is flexible in the longitudinal direction of the bracelet by virture of hinge pins 5 and 6 inserted into bores 3 and 4, respectively.

Figure 3:
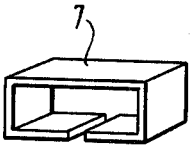
Fig.3 (PRIOR ART)
FIGS. 3 and 4 are perspective detail views of two individual links according to prior art.
Figure 4:
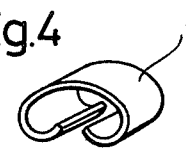
Fig.4 (PRIOR ART)

FIGS. 3 and 4 show various embodiments of individual links 7 or 8, respectively, which are formed by a conventional bending of a metal strip. In order to obtain smooth edges, the interstices remaining between the hinge pins and the metal strips must be filled with suitably shaped filler material and the longitudinal edges of the bracelet must then be subjected to a pressing process. Due to this procedure as well as the high cost of labor involved in making the individual links by repeated bending processes, only relatively simple structures can be produced with an economically justifiable outlay of funds.

Figure 5:
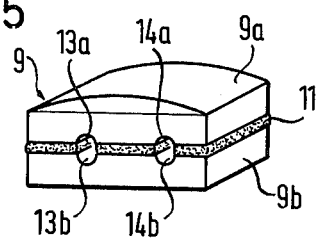
FIGS. 5 to 8 are perspective views of four different embodiments of individual links according to the invention.
Figure 6:
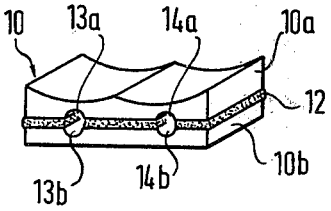

Turning now to FIGS. 5 and 6, there are respectively shown links 9 and 10 according to the present invention. Both links are made of two parts 9*a*, 9*b* and 10*a*, 10*b*, respectively. The link parts are bonded to one another by a weld seam 11 or 12, respectively, which, for better visibility, is shown greatly exaggerated in the drawing. Two longitudinally open grooves 13*a* and 14*a* which, when the link parts are combined, are in registry with two longitudinally open grooves 13*b* and 14*b*, respectively extend in each link part in a direction transverse to the longitudinal direction of the bracelet. These grooves begin at the common parting plane of both link parts and have a semicircular cross section so that associated grooves 13*a* and 13*b* or 14*a* and 14*b* form a bore of an approximately circular cross section to accommodate the hinge pins. Both link parts, including the grooves, can be produced of drawn material and are thus very economical items. It is no longer necessary to fill gaps between hinge pin and link. The secure positioning of the hinge pins also eliminates the chance that the bracelet might wear out even after long use.

Figure 7:
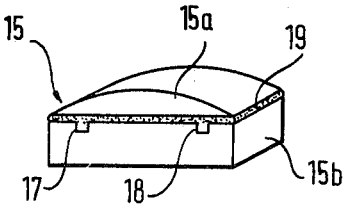
Figure 8:
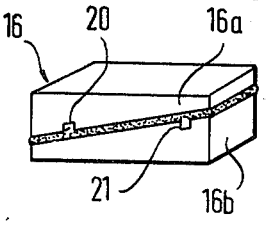

FIGS. 7 and 8 show two links 15 and 16, respectively, according to the present invention in which the bore for accommodating the hinge pin is formed by a single groove.

In link part 15*b* there are provided two longitudinally open gooves 17 and 18 having an approximately U-shaped cross section. The link part 15*a* has no grooves and thus, the grooves 17 and 18 are bounded by the parting plane of the link 15. The two link parts are bonded together by a weld seam 19.

In link 16 the parting plane is oblique; one groove 20 extends in the upper link part 16*a*, the other groove 21 is provided in the lower link part 16*b*. Both grooves have an approximately U-shaped cross section of identical configuration, so that the link of FIG. 8 can be combined of two completely identical link parts. The result is a very economical manufacturing process, particularly because only a single groove has to be provided in each link part.

It is to be understood that the present invention can also be practiced in case of bracelets where the links have a certain spacing between them in longitudinal direction. The links are then, contrary to the above-described embodiments, offset with respect to one another by more than one-half link length and consequently the transverse bores for accommodating the hinge pins must be placed further toward the outside so that they pass through the center of the overlap region.

It will be understood that the above description of the present invention is susceptible to various modifications, changes and adaptations, and the same are intended to be comprehended within the meaning and range of equivalents of the appended claims.

What is claimed is:

1. In a hinged bracelet formed of a plurality of links arranged in several juxtapositioned, longitudinally extending rows; adjacent links belonging to adjoining rows being offset with respect to one another and being articulated to one another by hinge pins extending transversely to the longitudinal direction of the bracelet; each link being tranversed by two hinge pins; the improvement wherein each link is formed of two link parts bonded to one another along a parting plane; each link having two throughgoing bores extending transversely to the longitudinal direction of the bracelet and being spaced from one another in said longitudinal direction; each bore being formed by a longitudinally open groove provided in at least one of said link parts, said groove facing, with its longitudinal opening, the other of said link parts; each bore accommodating one of said hinge pins.

2. A hinged bracelet as defined in claim 1, wherein the link parts are bonded to one another by a weld.

3. A hinged bracelet as defined in claim 1, wherein the hinge pins are held in a press fit in the bores of the links of the two outermost link rows.

4. A hinged bracelet as defined in claim 1, wherein each bore is formed by a first longitudinally open groove provided in one of said link parts and a second longitudinally open groove provided in the other of said link parts, said first and second grooves being in registry with one another and facing one another with their respective longitudinal opening.

5. A hinged bracelet as defined in claim 4, wherein each bore has a circular cross section.

6. A hinged bracelet as defined in claim 1, wherein each bore is formed by a sole longitudinally open groove provided in one of said link parts, said sole groove facing, with its longitudinal opening, the other one of said link parts.

7. A hinged bracelet as defined in claim 6, wherein in each said link the two grooves forming the one and the other bore are provided in the same link part.

8. A hinged bracelet as defined in claim 6, wherein in each said link the two grooves forming the one and the other bore are provided in different link parts.

9. A hinged bracelet as defined in claim 6, wherein the grooves have a generally U-shaped cross section.

10. A method of making the links of a hinged bracelet formed of a plurality of links arranged in several juxtapositioned, longitudinally extending rows, wherein adjacent links belonging to adjoining rows being offset with respect to one another and being articulated to one another by hinge pins extending transversely to the longitudinal direction of the bracelet and wherein each link is traversed by two spaced hinge pins; comprising the following steps:

a. continuously providing, by drawing, at least one groove in one face of a strip having a width corresponding to the link dimension measured in the longitudinal direction of the bracelet;

b. positioning two strips, prepared according to step (a), in a face-to-face engagement so that any groove on one strip is oriented to the other strip to form bores;

c. bonding the strips to one another at their engaging faces; and d. severing the unitary dual strip obtained in step (c) transversely to its longitudinal direction into individual links; each bore being adapted to accommodate one of the hinge pins.

11. A method as defined in claim 10, wherein said bonding is effectd by welding.

* * * * *